US009267501B2

(12) United States Patent
Akei

(10) Patent No.: US 9,267,501 B2
(45) Date of Patent: Feb. 23, 2016

(54) COMPRESSOR INCLUDING BIASING PASSAGE LOCATED RELATIVE TO BYPASS PORTING

(75) Inventor: Masao Akei, Miamisburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 46 days.

(21) Appl. No.: 13/453,491

(22) Filed: Apr. 23, 2012

(65) Prior Publication Data

US 2013/0078128 A1 Mar. 28, 2013

Related U.S. Application Data

(60) Provisional application No. 61/537,822, filed on Sep. 22, 2011.

(51) Int. Cl.

| | |
|---|---|
| ***F04C 18/02*** | (2006.01) |
| ***F04C 28/26*** | (2006.01) |
| ***F04C 27/00*** | (2006.01) |
| ***F04C 29/12*** | (2006.01) |

(52) U.S. Cl.

CPC ..... *F04C 18/0261* (2013.01); *F04C 18/0215* (2013.01); *F04C 27/005* (2013.01); *F04C 28/26* (2013.01); *F04C 29/126* (2013.01)

(58) Field of Classification Search

CPC .. F04C 18/02; F04C 18/0215; F04C 18/0261; F04C 27/005; F04C 28/26; F04C 29/126

USPC ..... 418/55.5, 15, 55.2, 55.4, 150; 417/310, 417/213

See application file for complete search history.

(56) References Cited

U.S. PATENT DOCUMENTS 4,497,615 A 2/1985 Griffith
5,611,674 A * 3/1997 Bass et al. ..... 417/220

(Continued)

FOREIGN PATENT DOCUMENTS

EP 1772629 A2 4/2007
JP 2010196688 A 9/2010

(Continued)

OTHER PUBLICATIONS

International Search Report regarding Application No. PCT/US2012/056064, mailed Feb. 19, 2013.

(Continued)

*Primary Examiner* — Jorge Pereiro
*Assistant Examiner* — Paul Thiede
(74) *Attorney, Agent, or Firm* — Harness, Dickey & Pierce, P.L.C.

(57) ABSTRACT

A compressor may include a first scroll member, a second scroll member and a seal engaged with the second scroll member. The first scroll member may include a first end plate having a first spiral wrap extending therefrom. The second scroll member may be supported relative to the first scroll member and may include a second end plate having a second spiral wrap extending therefrom and meshingly engaged with said first spiral wrap. The second end plate may define a discharge port, bypass porting and a biasing passage. The biasing passage may be in communication with the bypass porting during a portion of a compression cycle of the compressor. The seal and the second scroll member may define an axial biasing chamber in communication with the biasing passage.

9 Claims, 7 Drawing Sheets

(56) References Cited

U.S. PATENT DOCUMENTS

| | | | | |
|---|---|---|---|---|
| 5,674,058 | A | 10/1997 | Matsuda et al. | |
| 5,829,959 | A * | 11/1998 | Tsubono et al. | 418/55.5 |
| 5,855,475 | A | 1/1999 | Fujio et al. | |
| 6,273,691 | B1 | 8/2001 | Morimoto et al. | |
| 6,419,457 | B1 * | 7/2002 | Seibel et al. | 417/213 |
| 6,454,551 | B2 | 9/2002 | Kuroki et al. | |
| 6,464,481 | B2 | 10/2002 | Tsubai et al. | |
| 6,506,036 | B2 | 1/2003 | Tsubai et al. | |
| 6,544,016 | B2 | 4/2003 | Gennami et al. | |
| 6,558,143 | B2 | 5/2003 | Nakajima et al. | |
| 6,589,035 | B1 | 7/2003 | Tsubono et al. | |
| 6,769,888 | B2 | 8/2004 | Tsubono et al. | |
| 6,881,046 | B2 | 4/2005 | Shibamoto et al. | |
| 7,118,358 | B2 | 10/2006 | Tsubono et al. | |
| 7,137,796 | B2 | 11/2006 | Tsubono et al. | |
| 7,354,259 | B2 | 4/2008 | Tsubono et al. | |
| 7,393,190 | B2 | 7/2008 | Lee et al. | |
| 7,404,706 | B2 | 7/2008 | Ishikawa et al. | |
| 7,976,296 | B2 * | 7/2011 | Stover et al. | 418/55.5 |
| 7,988,433 | B2 * | 8/2011 | Akei et al. | 418/55.5 |
| 2002/0039540 | A1 | 4/2002 | Kuroki et al. | |
| 2004/0146419 | A1 | 7/2004 | Kawaguchi et al. | |
| 2006/0057010 | A1 | 3/2006 | Tsubono et al. | |
| 2006/0210416 | A1 | 9/2006 | Morimoto et al. | |
| 2007/0217938 | A1 | 9/2007 | Cho | |
| 2007/0269326 | A1 * | 11/2007 | Seibel et al. | 418/55.1 |
| 2009/0074600 | A1 | 3/2009 | Shimizu et al. | |
| 2009/0297378 | A1 | 12/2009 | Stover et al. | |
| 2010/0111741 | A1 | 5/2010 | Chikano et al. | |
| 2010/0221133 | A1 | 9/2010 | Nishikawa et al. | |
| 2010/0254841 | A1 | 10/2010 | Akei et al. | |
| 2010/0303659 | A1 | 12/2010 | Stover et al. | |
| 2011/0206548 | A1 * | 8/2011 | Doepker | 418/55.2 |

FOREIGN PATENT DOCUMENTS

| | | | |
|---|---|---|---|
| JP | 2010276001 | A | 12/2010 |
| JP | 2011012629 | A | 1/2011 |

OTHER PUBLICATIONS

Written Opinion of the International Searching Authority regarding Application No. PCT/US2012/056064, mailed Feb. 19, 2013.

First Office Action regarding China Application No. 201210357238.0 dated Sep. 28, 2014. Translation provided by Unitalen Attorneys At Law.

* cited by examiner

COMPRESSOR INCLUDING BIASING PASSAGE LOCATED RELATIVE TO BYPASS PORTING

CROSS-REFERENCE TO RELATED APPLICATIONS

This application claims the benefit of U.S. Provisional Application No. 61/537,822, filed on Sep. 22, 2011. The entire disclosure of the above application is incorporated herein by reference.

FIELD

The present disclosure relates to compressors.

SUMMARY

A compressor may include a first scroll member, a second scroll member and a seal engaged with the second scroll member. The first scroll member may include a first end plate having a first spiral wrap extending therefrom. The second scroll member may be supported relative to the first scroll member and may include a second end plate having a second spiral wrap extending therefrom and meshingly engaged with said first spiral wrap. The second end plate may define a discharge port, bypass porting and a biasing passage. The biasing passage may be in communication with the bypass porting during a portion of a compression cycle of the compressor. The seal and the second scroll member may define an axial biasing chamber in communication with the biasing passage.

The compressor may additionally include a valve in communication with the bypass porting and displaceable between first and second positions. The valve may isolate the bypass porting from communication with a discharge pressure region of the compressor when in the first position and may provide communication between the bypass porting and the discharge pressure region when in the second position.

The second scroll member may be a non-orbiting scroll member. The biasing passage may be located directly adjacent to a radially outer surface of the second spiral wrap. Alternatively, the biasing passage may be located directly adjacent to a radially inner surface of the second spiral wrap. The bypass porting may include a first bypass port defining a radially outermost bypass port. The bypass porting may include a second bypass port defined in the second end plate and located radially inward along the second spiral wrap relative to the first bypass port.

The second scroll member may be axially displaceable relative to the first scroll member. The compressor may additionally include a shell housing the first and second scroll members. The second scroll member may be axially displaceable relative to the shell. The shell may define a discharge passage in communication with the discharge port. The seal may engage the shell around the discharge passage and isolate the discharge passage from the axial biasing chamber. The second scroll member may be rotationally fixed relative to the shell.

The biasing passage may be located at least 270 degrees outward from the bypass porting along the second spiral wrap. The first and second spiral wraps may initially define an intermediate pocket at a suction seal-off condition and progressively compress fluid within the intermediate pocket during compressor operation until the intermediate pocket is in communication with the discharge port. The intermediate pocket may be in communication with the bypass porting no earlier than an angle ($\alpha$) of orbital displacement of the first scroll member relative to the second scroll member defined by:

$$\alpha = \left(1 - \frac{1}{VR}\right)\left(\Phi - \frac{R_{or}}{2R_g}\right)\left(\frac{180}{\pi}\right);$$

where VR is a volume ratio of the compressor defined by the bypass porting, $R_{or}$ is radius of first spiral wrap orbiting motion, $R_g$ is a base circle radius defining an involute curve of the second spiral wrap and is defined by:

$$R_g = \frac{T - R_{or}}{\pi};$$

where T is thickness of the second spiral wrap, $\Phi$ is an angle defining second spiral wrap length defined by:

$$\Phi = \frac{1}{2}\left(\frac{L}{R_g} - \pi\right);$$

where L is a maximum distance defined between inner radial surfaces of the second spiral wrap.

The bypass porting may include a first bypass port defining a radially outermost bypass port. Initial communication between the intermediate pocket and the bypass porting may include the first bypass port being in communication with the intermediate pocket after orbital displacement of the first scroll member relative to the second scroll member by at least angle ($\alpha$) from the suction seal-off condition. The biasing passage may be located no more than ($\alpha$−270) degrees inward along an outer radial surface of the second spiral wrap from where the intermediate pocket is formed at the suction seal-off condition. Alternatively, the biasing passage may be located no more than ($\alpha$−270) degrees inward along an inner radial surface of the second spiral wrap from where the intermediate pocket is formed at the suction seal-off condition.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
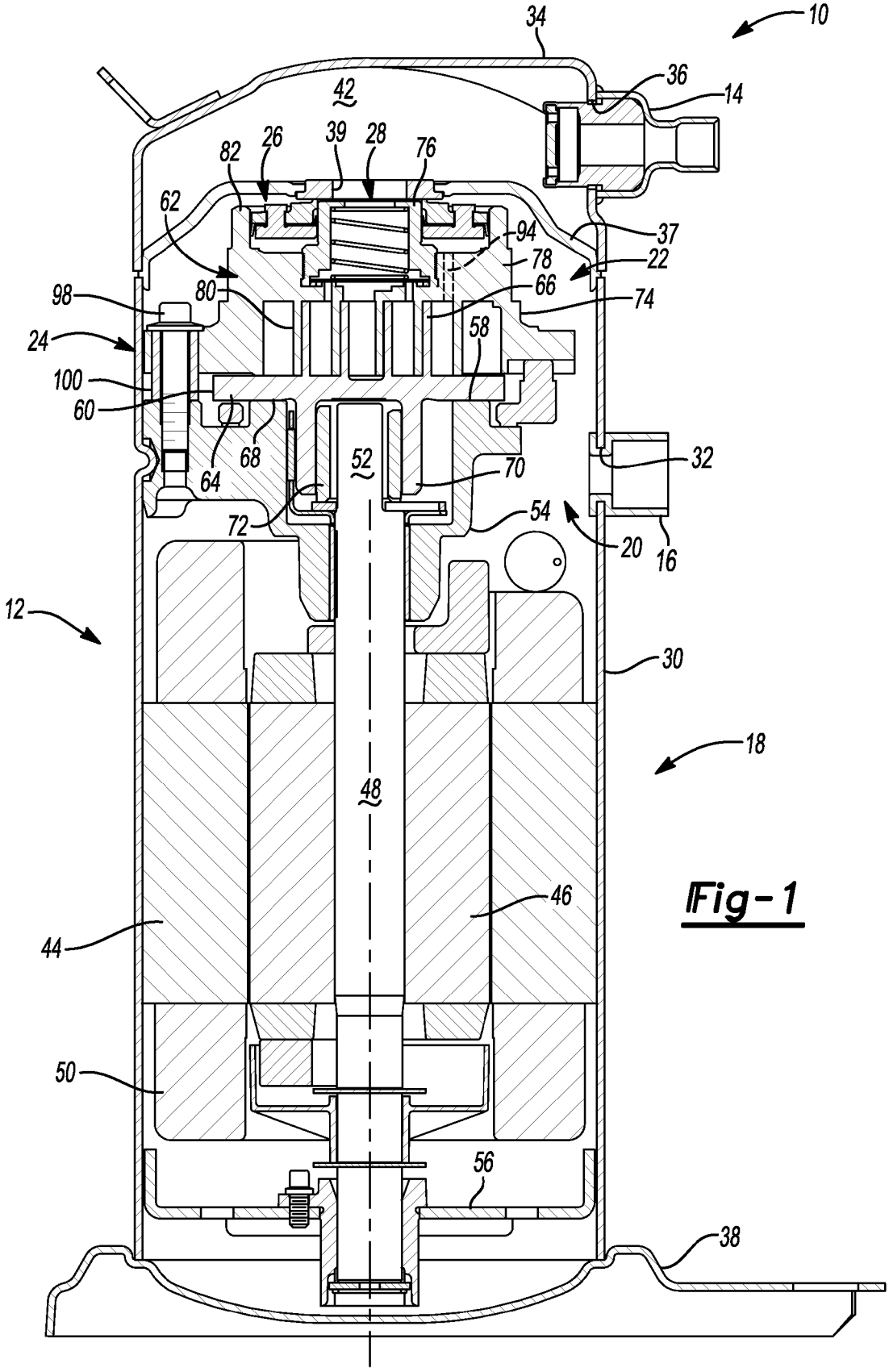
FIG. 1 is a section view of a compressor according to the present disclosure.

The following description is merely exemplary in nature and is not intended to limit the present disclosure, application, or uses. It should be understood that throughout the drawings, corresponding reference numerals indicate like or corresponding parts and features. The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

With reference to FIG. 1, compressor 10 may include a housing 12, a refrigerant discharge fitting 14, a suction gas inlet fitting 16, a motor assembly 18, a bearing housing assembly 20, a compression mechanism 22, a retaining assembly 24, a seal assembly 26, and a valve assembly 28.

Housing 12 may house motor assembly 18, bearing housing assembly 20, and compression mechanism 22. Housing 12 may include a longitudinally extending shell 30 having a suction gas inlet 32, an end cap 34 having a discharge gas outlet 36, a transversely extending partition 37, and a base 38. End cap 34 may be fixed to an upper end of shell 30. Base 38 may be fixed to a lower end of shell 30. End cap 34 and partition 37 may generally define a discharge chamber 42. Partition 37 may include an aperture 39 providing communication between compression mechanism 22 and discharge chamber 42. Discharge chamber 42 may generally form a discharge muffler for compressor 10. Refrigerant discharge fitting 14 may be attached to housing 12 at discharge gas outlet 36 in end cap 34. Suction gas inlet fitting 16 may be attached to shell 30 at suction gas inlet 32. While illustrated as including a discharge chamber 42, it is understood that the present disclosure is not limited to compressors having discharge chambers and applies equally to direct discharge configurations.

Motor assembly 18 may generally include a motor stator 44, a rotor 46, and a drive shaft 48. Windings 50 may pass through motor stator 44. Motor stator 44 may be press fit into shell 30. Drive shaft 48 may be rotatably driven by rotor 46 and supported by the bearing housing assembly 20. Drive shaft 48 may include an eccentric crank pin 52 having a flat thereon for driving engagement with compression mechanism 22. Rotor 46 may be press fit on drive shaft 48. Bearing housing assembly 20 may include a main bearing housing 54 and a lower bearing housing 56 fixed within shell 30. Main bearing housing 54 may include an annular flat thrust bearing surface 58 that supports compression mechanism 22 thereon.

Compression mechanism 22 may be driven by motor assembly 18 and may generally include a first scroll member 60 and a second scroll member 62. The first scroll member 60 may form an orbiting scroll member and may include a first end plate 64 having a first spiral wrap 66 on the upper surface thereof and an annular flat thrust surface 68 on the lower surface. Thrust surface 68 may interface with an annular flat thrust bearing surface 58 on main bearing housing 54. A cylindrical hub 70 may project downwardly from thrust surface 68 and may have a drive bushing 72 rotatively disposed therein. Drive bushing 72 may include an inner bore in which crank pin 52 is drivingly disposed. Crank pin 52 may drivingly engage a flat surface in a portion of the inner bore of drive bushing 72 to provide a radially compliant driving arrangement.

Figure 2:
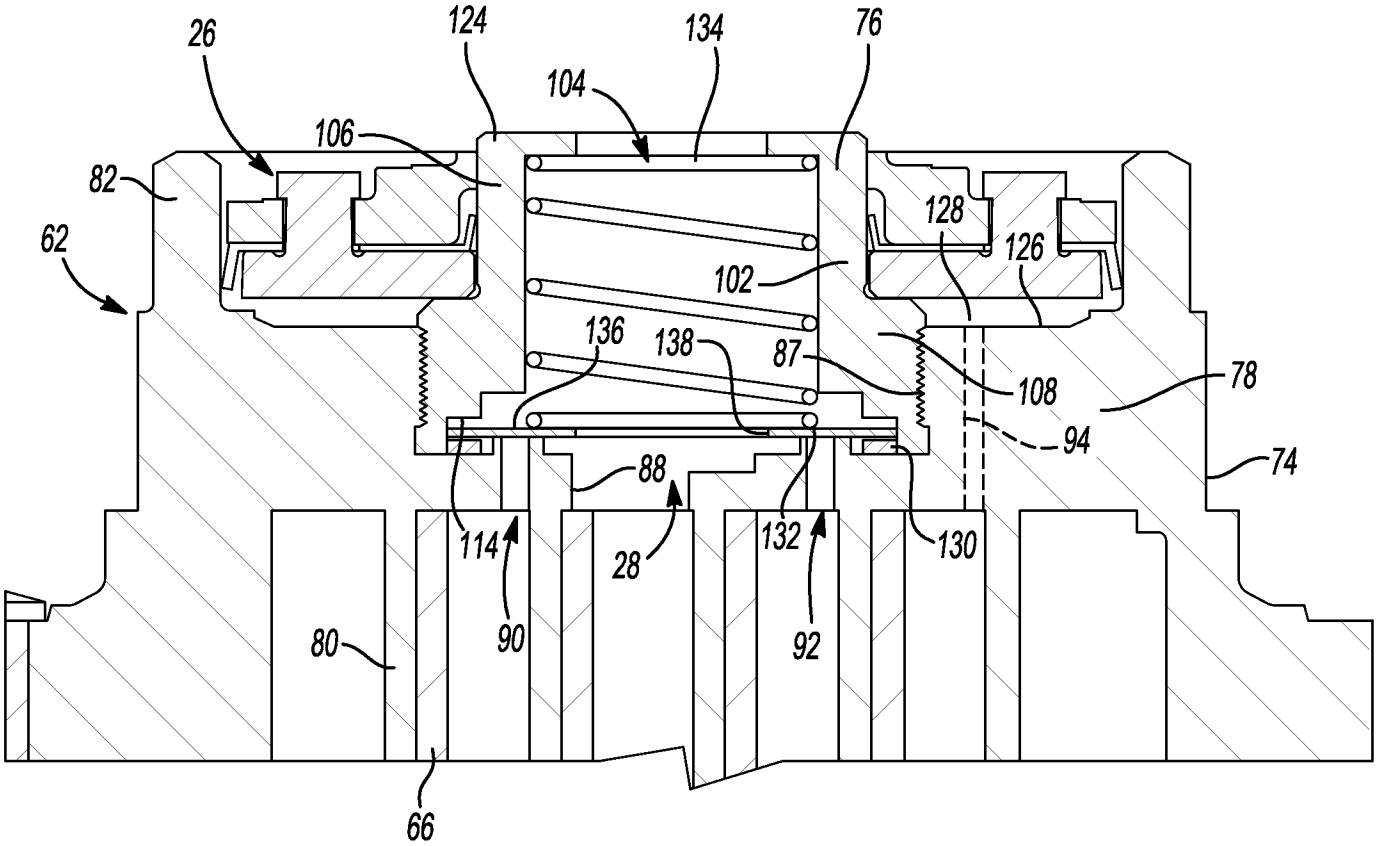
FIG. 2 is a fragmentary section view of the compressor of FIG. 1.
Figure 3:
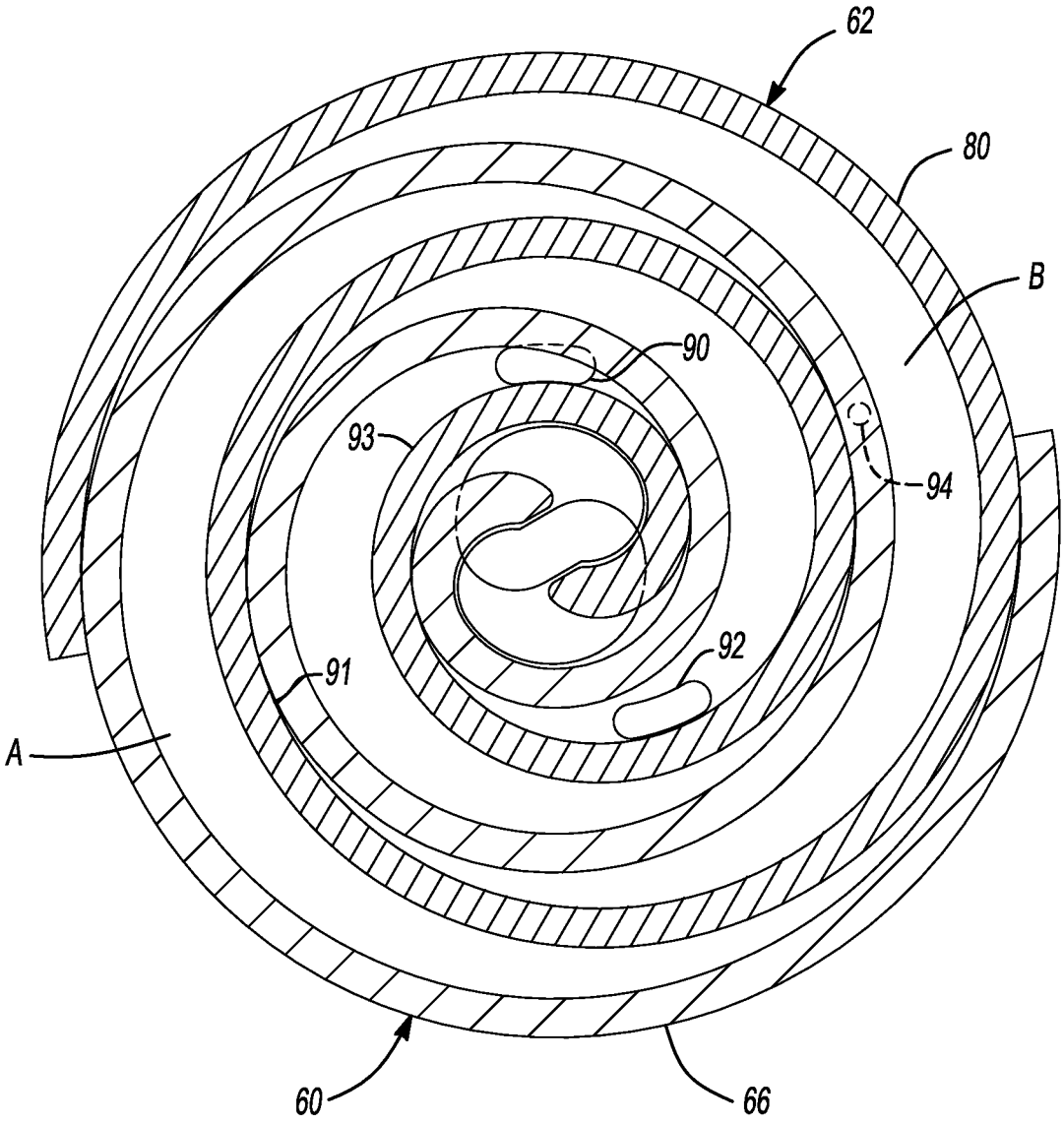
FIG. 3 is a schematic illustration of the first and second scroll members shown in FIG. 1.

As seen in FIG. 2, the second scroll member 62 may form a non-orbiting scroll assembly and may include a non-orbiting scroll member 74 and a hub member 76. Non-orbiting scroll member 74 may include a second end plate 78, a second spiral wrap 80, and a first annular wall 82. A first region of second end plate 78 may be located radially within first annular wall 82 and a second region of second end plate 78 may be located radially within the first region. The second region may define a recess forming a stepped region between the first and second regions. A primary discharge port 88 and bypass porting formed by first and second bypass ports 90, 92 may be located within the recess defined by second region. More specifically, the second region may include a wall 87 surrounding primary discharge port 88 and first and second bypass ports 90, 92. First and second bypass ports 90, 92 may form variable volume ratio (VVR) ports. A biasing passage 94 may be located radially between first annular wall 82 and wall 87 and outward from the first and second bypass ports 90, 92.

As seen in FIGS. 3-6, the first and second bypass ports 90, 92 may be located radially between an inner radial surface 91 defined by the second spiral wrap 80 and an outer radial surface 93 defined by the second spiral wrap 80 opposite the inner radial surface 91. In the present non-limiting example, the first bypass port 90 is located directly adjacent to the outer radial surface 93 of the second spiral wrap 80 and the second bypass port 92 is located directly adjacent to the inner radial surface 91 of the second spiral wrap 80. The first bypass port 90 may be located further outward along the second spiral wrap 80 than the second bypass port 92 relative to the outer radial surface 93 of the second spiral wrap 80. Therefore, the first bypass port 90 may form an outermost bypass port.

In the present non-limiting example, the biasing passage 94 may also be located directly adjacent to the outer radial surface 93 of the second spiral wrap 80. However, the biasing passage 94 may be spaced outward along the second spiral wrap 80 from the bypass porting. More specifically, the biasing passage 94 may be spaced outward along the second spiral wrap 80 from the first bypass port 90. The biasing passage 94 may be located at least two hundred and seventy degrees outward along the second spiral wrap 80 from an outermost portion of the first bypass port 90.

Figure 6:
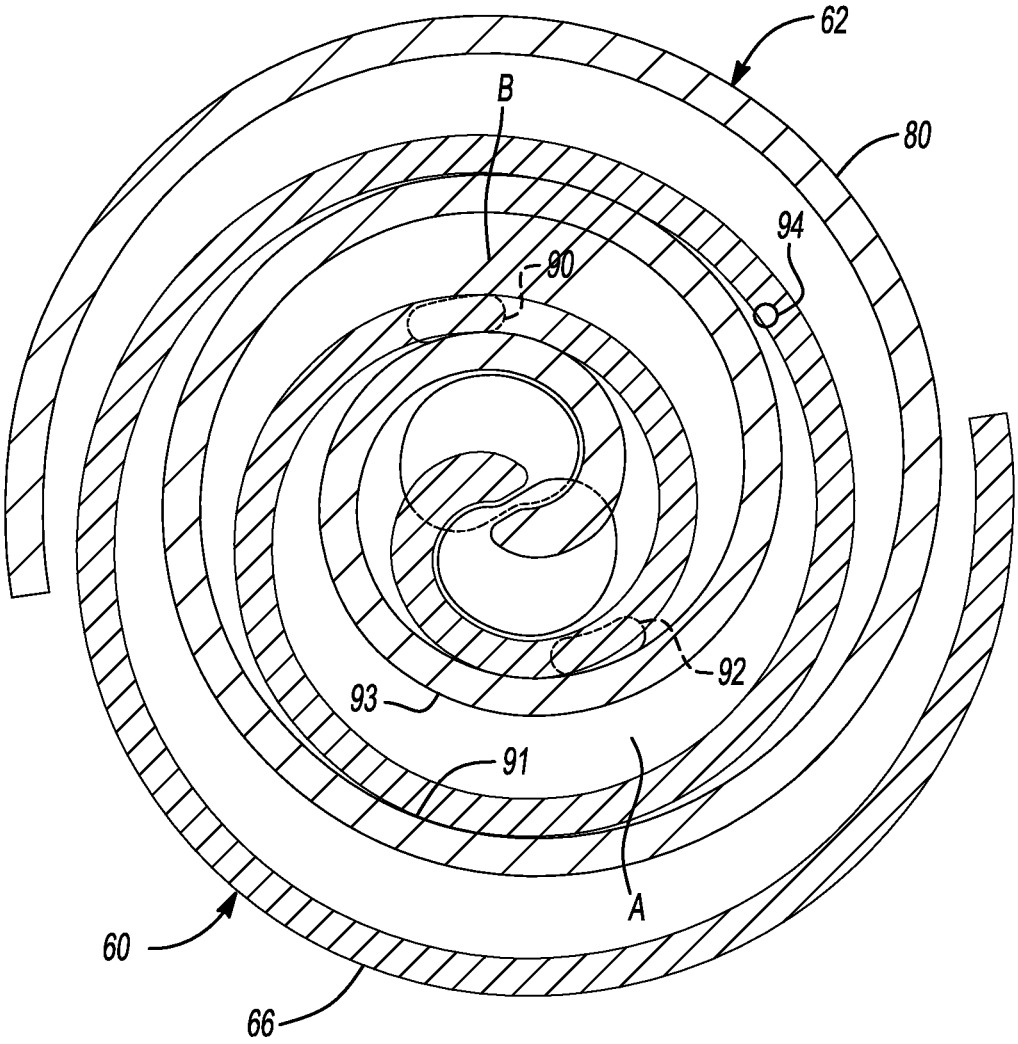
FIG. 6 is an additional schematic illustration of the first and second scroll members shown in FIG. 1.
Figure 7:
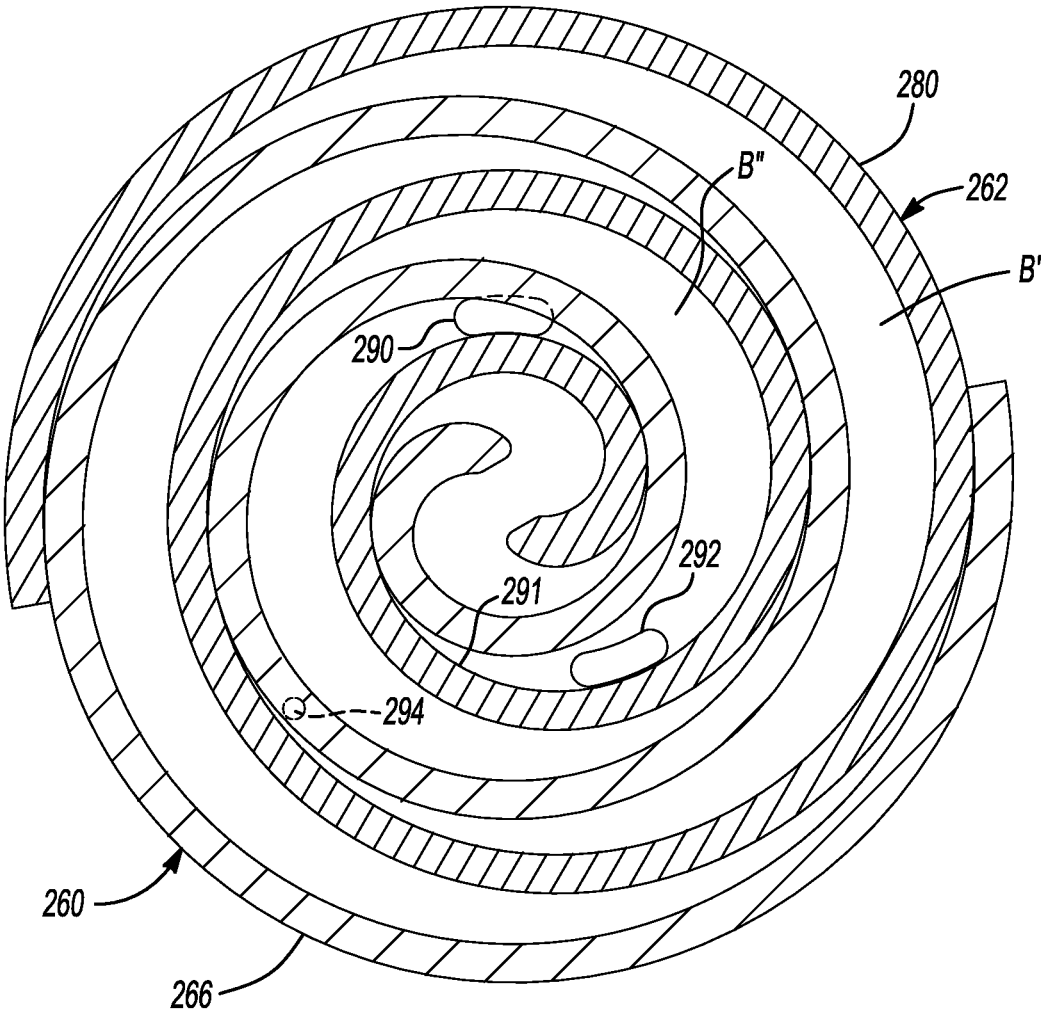
FIG. 7 is a schematic illustration of an alternate second scroll member according to the present disclosure.

An alternate second scroll member 262 is illustrated in FIG. 7. The second scroll member 262 may be generally similar to the second scroll member 62 shown in FIGS. 1-6 with the exceptions noted below. Therefore, it is understood that the second scroll member 262 may be incorporated into the compressor 10 in place of the second scroll member 62. The second scroll member 262 may include a biasing passage 294 located directly adjacent to the inner radial surface 291 of the second spiral wrap 280 and spaced outward along the second spiral wrap 280 from the bypass porting. More specifically, biasing passage 294 may be spaced outward along the second spiral wrap 280 from the second bypass port 292. The biasing passage 294 may be located at least two hundred and seventy degrees outward along the second spiral wrap 280 from an outermost portion of the second bypass port 292.

Referring back to FIGS. 1-6, second spiral wrap 80 may form a meshing engagement with first spiral wrap 66 of first scroll member 60, thereby creating a series of pockets. The pockets created by first and second spiral wraps 66, 80 may change throughout a compression cycle of compression mechanism 22 and may include suction, intermediate and discharge pockets.

Primary discharge port 88 may be in communication with the discharge pocket, the first and second bypass ports 90, 92 may be in communication with intermediate pockets or the discharge pocket, and biasing passage 94 may also be in communication with an intermediate pocket as discussed below. The biasing passage 94 may be located radially outward relative to the first and second bypass ports 90, 92. Non-orbiting scroll member 74 may be rotationally fixed relative to main bearing housing 54 by retaining assembly 24 for limited axial displacement based on pressurized gas from biasing passage 94. Retaining assembly 24 may generally include a fastener 98 and a bushing 100 extending through non-orbiting scroll member 74. Fastener 98 may be fixed to main bearing housing 54.

Referring to FIG. 2, hub member 76 may include a generally annular body 102 defining a discharge passage 104 that forms a discharge pressure region in communication with primary discharge port 88 and discharge chamber 42. Hub member 76 may include first and second portions 106, 108. Second portion 108 may be coupled to non-orbiting scroll member 74. A valve stop 114 may be defined within primary discharge port 88 by a stepped region between first and second portions 106, 108. First portion 106 of hub member 76 may form a second annular wall 124 that is located radially inward relative to first annular wall 82. First and second annular walls 82, 124 and second end plate 78 may cooperate to form an annular recess 126 for axial biasing of second scroll member 62.

Seal assembly 26 may be disposed within annular recess 126 and may be sealingly engaged with first and second annular walls 82, 124 and partition 37 to form an annular chamber 128 that is in communication with biasing passage 94 and that is isolated from suction and discharge pressure regions of compressor 10.

Valve assembly 28 may be located within hub member 76 and may include a retainer 130, a valve member 132, and a biasing member 134. More specifically, valve assembly 28 may be located within discharge passage 104 defined by hub member 76. Retainer 130 may be fixed to an end of second portion 108 of hub member 76 and valve member 132 may be located and axially retained between valve stop 114 and retainer 130. Valve member 132 may be displaceable between open and closed positions and may be initially biased into a closed position by biasing member 134. Biasing member 134 may take a variety of forms including, but not limited to, helical, crescent washer or wave washer type springs.

Valve member 132 may include an annular body 136 that defines an aperture 138. Annular body 136 may be radially aligned with first and second bypass ports 90, 92 and aperture 138 may be radially aligned with primary discharge port 88. When in the closed position, valve member 132 may seal the first and second bypass ports 90, 92 from communication with discharge passage 104 of hub member 76.

Primary discharge port 88 may be in communication with aperture 39 in partition 37 through aperture 138 in valve member 132 when valve member 132 is in the closed position. When in the open position, valve member 132 may be axially offset from second end plate 78 and may abut valve stop 114 to provide communication between the first and second bypass ports 90, 92 and discharge passage 104 of hub member 76. Primary discharge port 88 may be in communication with aperture 39 in partition 37 when valve member 132 is in the open position. Therefore, primary discharge port 88 and the first and second bypass ports 90, 92 may each act as discharge ports when the valve member is in the open position.

For simplicity, operation relative to a single compression cycle will be discussed. During operation, a compression cycle begins at a first suction seal-off condition illustrated in FIG. 3. The first suction seal-off condition may be defined when the first and second scroll members 60, 62 first define intermediate compression pockets A, B. In the non-limiting example shown in FIG. 3, the compression pocket A at the first suction seal-off condition is formed along the outer radial surface 93 between one hundred and eighty degrees and five hundred and forty degrees from a radial outermost end of the second spiral wrap 80, and the compression pocket B at the first suction seal-off condition is formed along the inner radial surface 91 between zero degrees and three hundred and sixty degrees from the radial outermost end of the second spiral wrap 80. The intermediate compression pockets A, B progress radially inward by orbital displacement of the first scroll member 60 and the volume of fluid within the pockets A, B is compressed until being discharged to the discharge pressure region of the compressor. Operation may be similar when second scroll member 262 is used in place of second scroll member 62.

Figure 4:
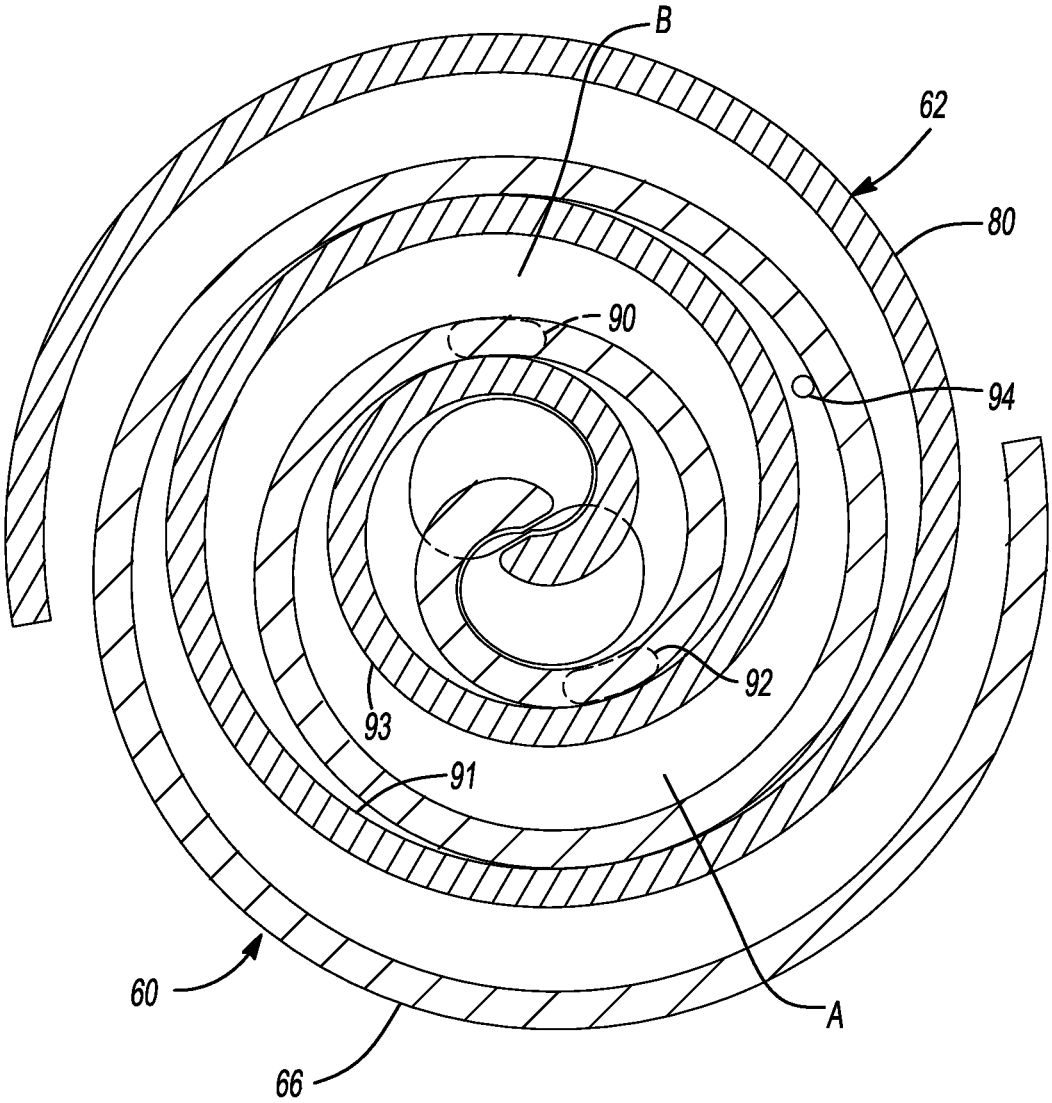
FIG. 4 is an additional schematic illustration of the first and second scroll members shown in FIG. 1.
Figure 5:
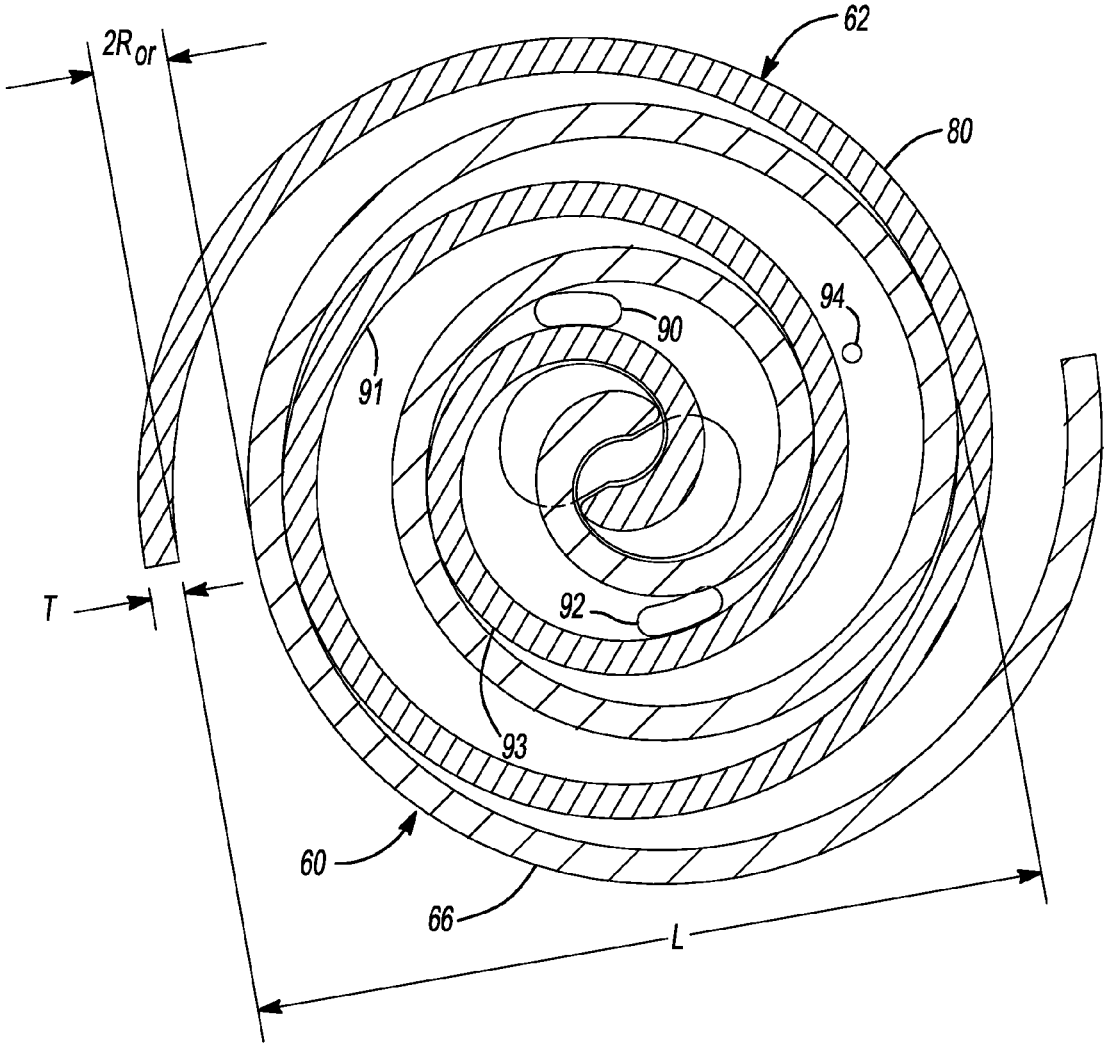
FIG. 5 is an additional schematic illustration of the first and second scroll members shown in FIG. 1.

As seen in FIG. 4, the first bypass port 90 may be exposed to the first intermediate compression pocket A and the second bypass port 92 may be exposed to the second intermediate compression pocket B after an angle ($\alpha$) of orbital displacement of the first scroll member 60 relative to the second scroll member 62. In the non-limiting example shown in FIG. 4, angle ($\alpha$) is greater than two hundred and seventy degrees. The angle ($\alpha$) may be defined by:

$$\alpha = \left(1 - \frac{1}{VR}\right)\left(\Phi - \frac{R_{or}}{2R_g}\right)\left(\frac{180}{\pi}\right);$$

where VR is volume ratio defined by the bypass porting:

$$VR=(PR)^{1/\gamma};$$

where PR is the minimum pressure ratio of the operating range of the compressor (ratio between discharge pressure and suction pressure) and $\gamma$ is the polytropic exponent of the refrigerant used in the compressor. $R_{or}$ is radius of first spiral wrap 66 orbiting motion illustrated in FIG. 5, $R_g$ is radius of a base circle defining an involute curve of first spiral wrap 66 and $\Phi$ is an angle defining length of second spiral wrap 80. $R_g$ is defined by:

$$R_g = \frac{T - R_{or}}{\pi};$$

where T is thickness of second spiral wrap 80 illustrated in FIG. 5. $\Phi$ is defined by:

$$\Phi = \frac{1}{2}\left(\frac{L}{R_g} - \pi\right);$$

where L is a maximum distance defined between inner radial surfaces of second spiral wrap 80 illustrated in FIG. 5.

Therefore, the location of the biasing passage 94 may alternatively be defined in terms of angle ($\alpha$). More specifically, the biasing passage 94 may be located no more than ($\alpha$−270) degrees inward along the outer radial surface 93 from where the compression pocket A is formed at the first suction seal-off condition. The location of biasing passage 94 may alternatively be defined relative to the radial outermost end of the second spiral wrap 80 and may be located no more than 540−($\alpha$−270) degrees (810−$\alpha$ degrees) inward along the outer radial surface 93 from the radial outermost end of the second spiral wrap 80.

As seen in FIG. 6, the biasing passage 94 may be at a location where the first bypass port 90 is in communication with the biasing passage 94 via the first intermediate compression pocket A during a portion of the compression cycle. The biasing passage 94 and the first bypass port 90 may be in communication with one another while the biasing passage 94 is being closed by the first spiral wrap 66 and the first bypass port 90 is opening to the first intermediate compression pocket A. The arrangement of the biasing passage 94 and the first bypass port 90 may accommodate an increased extent for the first and second bypass ports 90, 92.

FIG. 7 includes a similar compressor structure with a different port arrangement as shown in FIGS. 1-6. FIG. 7 includes a first scroll member 260 and a second scroll member 262. The first scroll member 260 may include a first spiral wrap 266 and a second spiral wrap 280 intermeshed together to form a first intermediate compression pocket B' and a second intermediate compression pocket B". The second scroll member 262 may include a biasing passage 294, a first bypass port 290, and a second bypass port 292.

The location of the biasing passage 294 may alternatively be defined in terms of angle ($\alpha$) relative to the inner radial surface 291 of the second spiral wrap 280. More specifically, the biasing passage 294 may be located no more than ($\alpha$−270) degrees inward along the inner radial surface 291 from where the first compression pocket B' is formed at the first suction seal-off condition. The location of the biasing passage 294 may alternatively be defined relative to the radial outermost end of the second spiral wrap 280 and may be located no more than 360−($\alpha$−270) degrees (630−$\alpha$ degrees) inward along the inner radial surface 291 from the radial outermost end of the second spiral wrap 280.

The biasing passage 294 may be at a location where the second bypass port 292 may be in communication with the biasing passage 294 via the second compression pocket B". In operation, as the first spiral wrap 266 orbits with respect to the second spiral wrap 280, the biasing passage 294 may be at a location where the biasing passage 294 is being closed by the first spiral wrap 266 while the second bypass port 292 is opening to the second intermediate compressor pocket B".

What is claimed is:

1. A compressor comprising:

a first scroll member including a first end plate having a first spiral wrap extending therefrom;

a second scroll member supported relative to said first scroll member and including a second end plate having a second spiral wrap extending therefrom and meshingly engaged with said first spiral wrap, said second end plate defining a discharge port, bypass porting and a biasing passage, said biasing passage being in communication with said bypass porting during a portion of a compression cycle of the compressor, said biasing passage located at least 270 degrees outward from said bypass porting along said second spiral wrap; and a seal engaged with said second scroll member, said seal and said second scroll member defining an axial biasing chamber in communication with said biasing passage, wherein said first and second spiral wraps initially define an intermediate pocket at a suction seal-off condition and progressively compress fluid within said intermediate pocket during compressor operation until said intermediate pocket is in communication with said discharge port, said intermediate pocket being in communication with said bypass porting no earlier than an angle $\alpha$ of orbital displacement of said first scroll member relative to said second scroll member defined by:

$$\alpha = \left(1 - \frac{1}{VR}\right)\left(\Phi - \frac{R_{or}}{2R_g}\right)\left(\frac{180}{\pi}\right);$$

where VR is a volume ratio of the compressor defined by said bypass porting, $R_{or}$ is radius of first spiral wrap orbiting motion, $R_g$ is a base circle radius defining an involute curve of said second spiral wrap and is defined by:

$$R_g = \frac{T - R_{or}}{\pi};$$

where T is thickness of said second spiral wrap, $\Phi$ is an angle indicative of second spiral wrap length and is defined by:

$$\Phi = \frac{1}{2}\left(\frac{L}{R_g} - \pi\right);$$

where L is a maximum distance defined between inner radial surfaces of said second spiral wrap.

2. The compressor of claim 1, wherein said bypass porting includes a first bypass port defining a radially outermost bypass port, initial communication between said intermediate pocket and said bypass porting including said first bypass port being in communication with said intermediate pocket after orbital displacement of said first scroll member relative to said second scroll member by at least said angle α from said suction seal-off condition.

3. The compressor of claim 2, wherein said biasing passage is located no more than said angle α minus 270 degrees inward along an outer radial surface of said second spiral wrap from where said intermediate pocket is formed at said suction seal-off condition.

4. The compressor of claim 2, wherein said biasing passage is located no more than said angle α minus 270 degrees inward along an inner radial surface of said second spiral wrap from where said intermediate pocket is formed at said suction seal-off condition.

5. A compressor comprising:

a first scroll member including a first end plate having a first spiral wrap extending therefrom;

a second scroll member supported relative to said first scroll member and including a second end plate having a second spiral wrap extending therefrom, said second end plate defining a discharge port, bypass porting and a biasing passage and said second spiral wrap is meshingly engaged with said first spiral wrap to initially define an intermediate pocket at a suction seal-off condition of said first and second spiral wraps, said intermediate pocket being progressively compressed during compressor operation and being in communication with said bypass porting no earlier than an angle α of orbital displacement of said first scroll member relative to said second scroll member defined by:

$$\alpha = \left(1 - \frac{1}{VR}\right)\left(\Phi - \frac{R_{or}}{2R_g}\right)\left(\frac{180}{\pi}\right);$$

where VR is volume ratio defined by said bypass porting, $R_{or}$ is radius of first spiral wrap orbiting motion, $R_g$ is a base circle radius defining an involute curve of said second spiral wrap and is defined by:

$$R_g = \frac{T - R_{or}}{\pi};$$

where T is thickness of said second spiral wrap, Φ is an angle indicative of second spiral wrap length and is defined by:

$$\Phi = \frac{1}{2}\left(\frac{L}{R_g} - \pi\right);$$

where L is a maximum distance defined between inner radial surfaces of said second spiral wrap; and a seal engaged with said second scroll member, said seal and said second scroll member defining a biasing chamber in communication with said biasing passage and said biasing passage being located no more than said angle a minus 270 degrees inward along said second spiral wrap from an outermost end of said second spiral wrap, said biasing passage being in communication with said bypass porting during a portion of a compression cycle of the compressor.

6. The compressor of claim 5, wherein said bypass porting includes a first bypass port defining a radially outermost bypass port, initial communication between said intermediate pocket and said bypass porting including said first bypass port being in communication with said intermediate pocket after orbital displacement of said first scroll member relative to said second scroll member by at least said angle α from said suction seal-off condition.

7. The compressor of claim 6, wherein said bypass porting includes a second bypass port defined in said second end plate and located radially inward along said second spiral wrap relative to said first bypass port.

8. The compressor of claim 5, wherein said biasing passage is located no more than said angle α minus 270 degrees inward along an outer radial surface of said second spiral wrap from where said intermediate pocket is formed at said suction seal-off condition.

9. The compressor of claim 5, wherein said biasing passage is located no more than said angle α minus 270 degrees inward along an inner radial surface of said second spiral wrap from where said intermediate pocket is formed at said suction seal-off condition.

* * * * *